United States Patent [19]

Imbert

[11] 4,350,339

[45] Sep. 21, 1982

[54] COMBINED DICE AND CARD GAME APPARATUS

[76] Inventor: Leon A. Imbert, 2313 Venus Dr., Ceres, Calif. 95307

[21] Appl. No.: 191,390

[22] Filed: Sep. 29, 1980

[51] Int. Cl.[3] ..... A63F 1/00; A63F 1/10

[52] U.S. Cl. ..... 273/148 A; 273/303

[58] Field of Search ..... 273/148 A, 236, 309, 273/303, 292, 274

[56] References Cited

U.S. PATENT DOCUMENTS 1,077,865 11/1913 Atkins ..... 273/DIG. 27 UX 3,921,982 11/1975 Feldman ..... 273/274

FOREIGN PATENT DOCUMENTS 292306 6/1928 United Kingdom ..... 273/292

*Primary Examiner*—Anton O. Oechsle

*Attorney, Agent, or Firm*—Huebner & Worrel

[57] ABSTRACT

A combined dice and card game apparatus having a board with an upwardly disposed planar surface and a recess in the surface provided with a plurality of dice fixed in spaced relation within the recess, the dice having individual upwardly disposed sides substantially coplanar with the surface so that conventional playing cards are supportable in bridging relation individually between each side and the surface for comparison of indicia of each die with indicia of the corresponding card to determine scoring in a game played with the apparatus.

9 Claims, 3 Drawing Figures

COMBINED DICE AND CARD GAME APPARATUS

BACKGROUND OF THE INVENTION

1. Field of the Invention

The present invention relates to a combined dice and card game apparatus, and more particularly to such an apparatus for playing a game of chance wherein scoring is determined by comparison of numerical values of playing cards with the numerical values of dice on which the cards are individually dealt.

2. Description of the Prior Art

The use of dice and of conventional playing cards in games of chance are, of course, well known. It is also well known to provide game apparatus including throwable dice utilized to determine the number of consecutive spaces or the like on a game board over which a move is to be made. Further, it is well known to determine a game action by drawing cards bearing indicia verbally describing possible game actions, the possible actions being unique to a predetermined game played with the apparatus.

However, insofar as is known to the applicant, there is no prior art game apparatus for the comparison of indicia of randomly selected conventional playing cards with indicia of dice-like elements forming a portion of the game board, the results of the comparison determining the scoring of a game played with the apparatus.

PRIOR ART STATEMENT

In accordance with 37 C.F.R. §1.97 and §1.98, the applicant states that he is not aware of any prior art, other than that heretofore described, which is relevant to the patentability of the subject invention.

SUMMARY OF THE INVENTION

It is an object of the present invention to provide a combined dice and card game apparatus.

Another object is to provide such an apparatus for playing a game wherein interest in conventional dice and playing cards utilized in games of chance are utilized together to enhance interest in the game.

Another object is to provide such an apparatus for playing a game which is simple and fast moving and in which scoring is determined by comparison of a plurality of dice-like elements of the apparatus with randomly selected conventional playing cards or the like.

Another object is to provide such an apparatus which facilitates selection of one of such elements for individual comparison with sequentially selected such cards.

Another object is to provide such an apparatus which facilitates collection of cards from the apparatus after such comparison.

A further object is to provide such an apparatus having these and other objects and advantages and which lends itself to a durable and attractive embodiment which is fully effective in performing its intended functions.

DESCRIPTION OF THE PREFERRED EMBODIMENT

Figure 1:
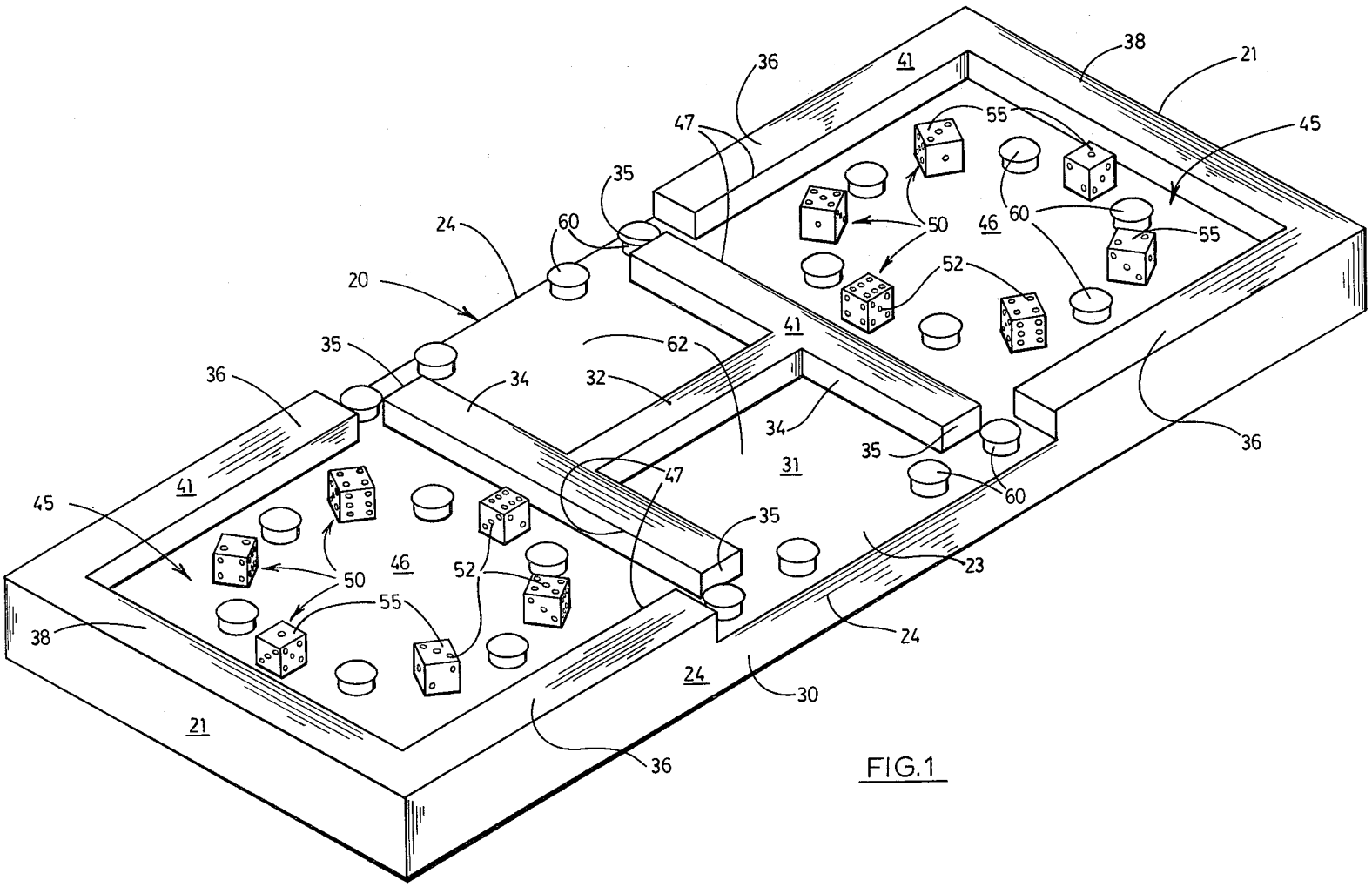
FIG. 1 is a perspective view of a combined card and dice game apparatus embodying the principles of the present invention.

Referring in greater particularity to the drawings, an apparatus 10 for playing a combined dice and card game is best shown in FIG. 1. The apparatus includes a plurality of counters 12, typically conventional poker chips, and with two decks 15 of conventional rectangular playing cards 16. The cards have faces bearing individual indicia 17, which assign each card a numerical value.

The apparatus 10 provides an elongated rectangular board 20, best shown in FIG. 1, having a pair of longitudinally opposite, parallel ends 21; a central portion 23; and a pair of opposite and parallel longitudinal sides 24. Typically, the ends have a length approximately equal to twice the length of one of the sides of a card 16, and the sides of the board have a length somewhat more than five times the length of such side of a card.

The board 20 has a base 30 providing an upwardly disposed planar area 31. The central portion 23 of the board is provided with an elongated central bar 32 extended across this area parallel to the sides 24, centered therebetween, and having a length slightly greater than a side of a card 16. The board has a pair of elongated transverse bars 34 individually parallel to the ends 21. Each transverse bar is substantially normal to the sides 24 and terminates at opposite ends 35 spaced equally inwardly therefrom. The centers of the transverse bars individually engage the opposite ends of the central bar. Each end portion of the board has a pair of elongated side bars 36 inwardly adjacent to the sides 24. Each side bar extends from the corresponding end 21 of the board to a point spaced somewhat toward this end from the transversely corresponding end 35 of the adjacent one of the transverse bars. The end portion has an end bar 38 disposed in inwardly adjacent relation to the corresponding end of the board and extended parallel to this end between the side bars thereat. The bars 32, 34, 36, and 38 are rectangular parallelepipeds having their upper sides in a common plane so as to define together a planar, upwardly disposed first or upper surface 41 of the board which extends between its ends. The bars and the base are unitarily constructed of any suitable material.

The base 30 and the bars 34, 36, and 38 define a pair of generally square recesses 45. The recesses are below the upper surface 41 and are individual to the end portions and adjacent to the ends 21. The length and width of each recess are substantially less than twice the length of a side of a card 16 due to the horizontal thickness of the bars. The portion of the area 31 substantially enclosed by the bars defining each recess is as an upwardly disposed, planar bottom surface 46 of the recess, which is substantially parallel to the upper surface. The bars defining each recess also define an edge 47 of the upper surface extended peripherally about the recess.

The apparatus 10 has twelve substantially identical dice 50, six of the dice being fixedly mounted in any suitable manner on the bottom surface 46 of each recess 45. There are thus a pair of pluralities of the dice, each plurality including six dice individual to each recess. Each die is of the usual cubical form having six sides, the opposite sides being spaced a distance substantially equal to the distance between the upper surface 41 and the bottom surface 46. The six sides of each die bear conventional dot indicia 52, there being a different number of dots, from one through six inclusively, on each of the six sides. Each die is disposed with one of its sides affixed to the bottom surface so that the dice in each recess provide six upwardly disposed second planar surfaces 55 individual to these dice. These six surfaces are substantially coplanar with the upper surface and, therefore, at the same elevation above the bottom surface. The dice of each recess are disposed so that the indicia of each of their upwardly facing surfaces has a different number of dots. The dot indicia thus indicate numerical value, from one through six inclusively, individual to each die in the recess. The six dice in each recess are arranged in a circle substantially centered in the recess and are substantially equally spaced circumferentially about the circle so that the dice are disposed in mutually spaced relation in the recess. The diameter of the circle is, typically, equal to the length of a side of the cards 16 so that each die and, of course, its upwardly disposed surface are adjacent to the peripheral edge 47. Due to the horizontal thickness of the bars 34, 36, and 38, the dice are spaced inwardly of this edge a distance substantially less the length of such a side.

The apparatus 10 is, typically, provided with twenty substantially identical, axially erect and generally cylindrical knobs 60 having an axial length and diameter substantially less than the distance between a pair of opposite sides of a die 50. The knobs are fixedly mounted on the area 31 of the board 20 in any suitable manner. Six of the knobs are disposed in each recess 45 in the circle of dice therein in alternating, equally circumferentially spaced relation with the dice. The remaining eight knobs are disposed in four pairs individually adjacent to each end 35 of the transverse bars 34, each pair being disposed along a line parallel to and inwardly of the corresponding side 24 of the board. One knob of each pair is adjacent to the corresponding side bar 36. The other knob of each pair is disposed somewhat oppositely of the corresponding transverse bar from this side bar. There are thus a pair of such other knobs adjacent to each side 24 of the board so as to define, together with the central bar 32 and the portions of the transverse bars extended therefrom toward this side, a pair of card storage pockets 62 in the central portion 23 of the board. These pockets are disposed oppositely of the central bars and serve individually to store the decks 15. The knobs 60 are largely for decorative purposes.

OPERATION

Figure 3:
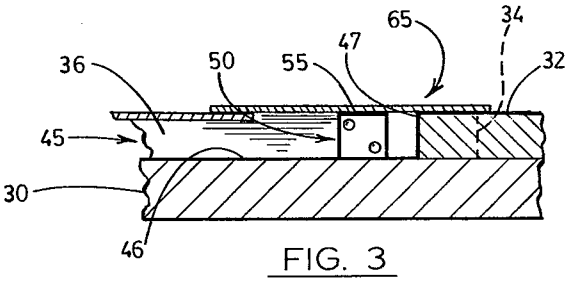
FIG. 3 is a fragmentary vertical section taken on line 3—3 of FIG. 2.
Figure 2:
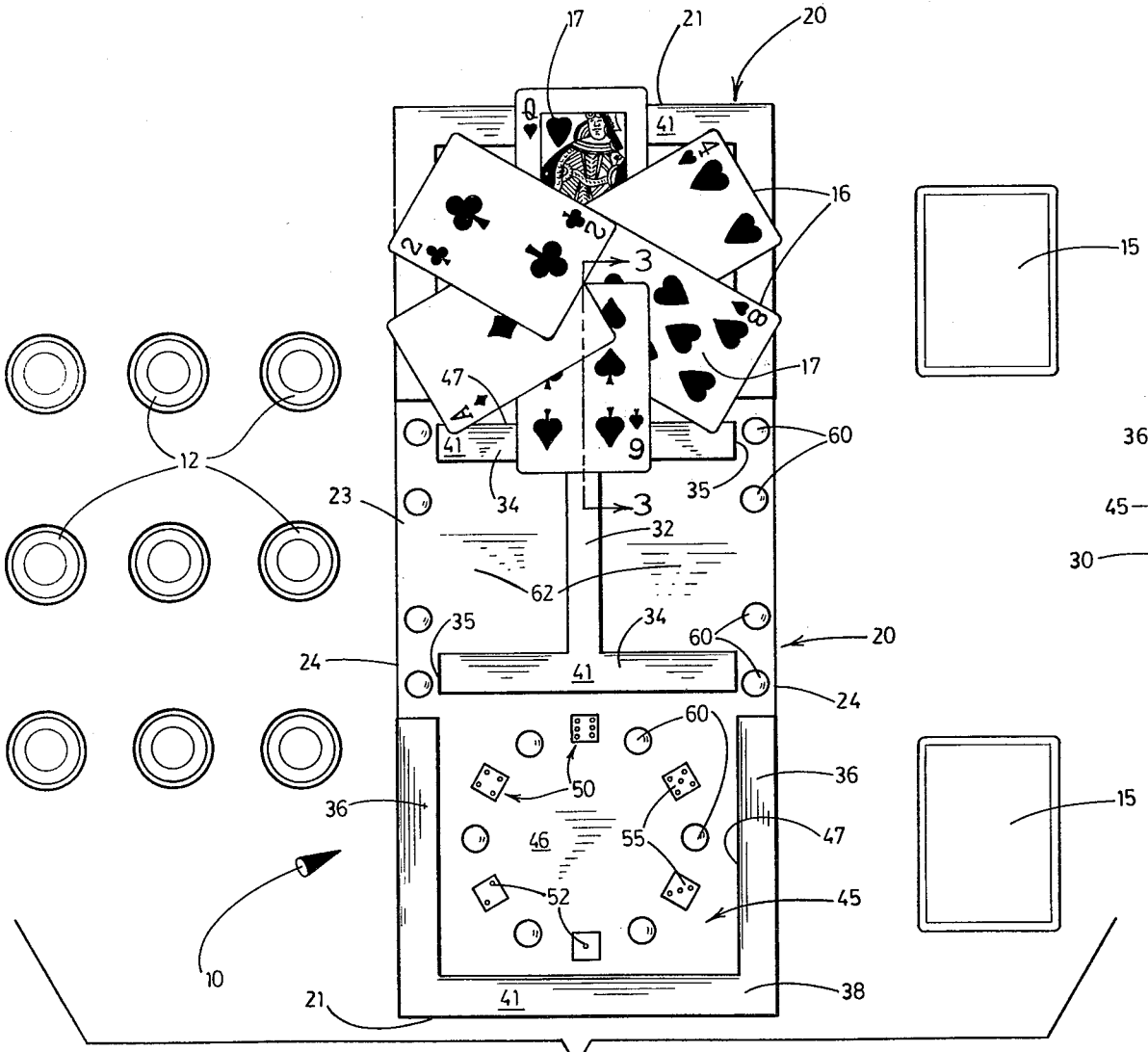
FIG. 2 is a plan view of the apparatus illustrating its use.

The operation of the described embodiment of the present invention is believed to be clearly apparent and is briefly summarized at this point. The apparatus 10 is utilized, as illustrated in FIGS. 2 and 3, in playing a combined dice and card game wherein six of the cards 16 are supported individually on the six dice 50 of one of the recesses 45. Each card is extended in bridging relation, as indicated by the numeral 65 and best shown in FIG. 3, between the upwardly disposed surface 55 of the corresponding die and the edge 47, the longer sides of the card being generally parallel to a radius of the circle of dice.

A representative game played with the apparatus 10 has two players, each using one of the two decks 15 of the cards 16. Each deck is shuffled in the usual manner and is placed face downwardly adjacent to one of the end portions of the board 20. Typically, the board is disposed with its sides 24 extended in a direction between the players who face each other. Each player thus has convenient access to one of the recesses 45 and to the corresponding deck. The game also utilizes a number of the counters 12. It has been found that nine of the counters is a suitable number for the representative game, and it is convenient to place the counters adjacent to the board in a three-by-three array. In playing the representative game with conventional playing cards, the indicia 17 of the cards are used to assign the cards individual numerical values from one to ten inclusively. In assigning these values, the face cards are all given a value of ten. The balance of the cards, other than joker cards which have a special significance, are assigned their usual value equal to the number of pips thereon. The numerical values of the cards are thus all less than a single predetermined value, namely eleven, as are the numerical values from one through six indicated by the dot indicia 52 of the surfaces 55.

To play the representative game, a first player selected by any suitable means deals six cards of his deck 15 successively and individually onto the six dice 50 in the recess 45 adjacent to the player. As each card is dealt, the recess facilitates grasping the card to place it in the bridging relation 65. In FIG. 2, the six cards are depicted as having been dealt onto the dice in clockwise direction commencing with the die nearest the corresponding end 21 of the board 20. As each card is dealt, the numerical value assigned by its indicia 17 is compared with the numerical value of the die on which the card is rested in the bridging relation. If the value of the card is less than or equal to that of the die, the player dealing the cards receives one point and the points so derived are totaled to give a score for the six cards. For variety, a joker card is not assigned a numerical value, but counts as two such points.

The opposing player then deals cards from the other deck similarly onto the six dice of the other recess and calculates the corresponding score. The player with the highest score is awarded one of the counters 12, no counter being awarded on a tie score. The six cards are then removed from the dice of each recess, grasping of the cards for removal being facilitated by the recess. The described play is then repeated, either by using the balance of the cards in each deck or, if all the cards are played, by reshuffling the deck. This play is continued until one player wins five of the nine counters. This player is then the "winner."

Although the invention has been herein shown and described in what is conceived to be the most practical and preferred embodiment, it is recognized that departures may be made therefrom within the scope of the invention, which is not to be limited to the illustrative details disclosed.

Having described my invention, what I claim as new and desire to secure by letters patent is:

1. A game apparatus comprising a deck of playing cards of substantially uniform length having indicia individual thereto assigning each card a respective numerical value and means having an upwardly disposed first surface and a plurality of upwardly disposed second surfaces which are substantially coplanar with the first surface and are disposed in spaced relation in a circle, the first surface extending about the second surfaces in spaced relation thereto; said second surfaces being spaced from said first surface less than the length of said cards and being adapted individually to receive a playing card rested thereon and on the first surface in bridging relation to the space therebetween; and each of the second surfaces bearing indicia indicating a numerical value individual thereto for comparison with the numerical value of the card rested thereon.

2. A combined dice and card game apparatus comprising:

A. a plurality of playing cards of a predetermined minimum length;

B. a board having a planar, upwardly disposed surface and a recess in the surface bounded by a peripheral edge; and C. a plurality of dice fixedly mounted on the board within the recess and disposed in mutually spaced relation therein, each die of said plurality providing an upwardly facing surface substantially coplanar with the upwardly disposed surface of the board and spaced inwardly of the recess from said edge a distance less than said minimum length so that a plurality of such cards equal in number to said plurality of dice are supportable individually thereon in bridging relation between said surfaces of the dice and said edge.

3. The apparatus of claim 2 wherein the board is elongated and has opposite end portions and wherein the recess is one of a pair of such recesses and the plurality of dice is one of a pair of such pluralities individual to the recesses, the recesses being disposed individually in the end portions for access by a pair of facing players using the apparatus.

4. The apparatus of claim 2 wherein the plurality of dice are disposed in a circle within the recess.

5. The apparatus of claim 2 wherein each card bears indicia assigning the card a numerical value and each of the upwardly facing surfaces of the plurality of dice bears indicia indicating a numerical value for comparison with the numerical value of a card supported on said surface in said bridging relation.

6. The apparatus of claim 5 wherein said plurality is six cubical dice, and the indicia of said upwardly disposed surfaces thereof individually indicate numerical values from one through six inclusively.

7. A combined dice and card game apparatus comprising:

A. a plurality of playing cards individually of a predetermined length bearing individual indicia assigning each card a numerical value from one through ten inclusively;

B. an elongated board having opposite ends, an upwardly disposed upper planar surface extended between the ends, and a pair of recesses individually adjacent thereto, each recess being sunk below said surface defining an edge thereof peripherally about the recess and having a bottom surface substantially parallel to the upper surface; and C. six cubical dice disposed in each recess and fixedly mounted on the bottom surface thereof in substantially equally circumferentially spaced relation about a circle substantially centered in said recess with the dice spaced from said edge a distance substantially less than said length of the cards, each die having opposite sides spaced a distance substantially equal to the distance between the upper surface and the bottom surface and one of the sides being upwardly disposed in substantially coplanar relation with the upper surface and bearing indicia indicating a numerical value between one and six inclusively.

8. The apparatus of claim 7 wherein the indicia borne by the upwardly disposed sides of the dice indicate a different numerical value for each die.

9. A combined dice and card game apparatus comprising

A. a plurality of playing cards of a predetermined minimum length; and

B. means for supporting the cards having (1) a plurality of dice disposed in mutually spaced relation having upwardly disposed surfaces, and (2) bar means arranged about the dice having other upwardly disposed surfaces spaced from surfaces of respective die distances less than said minimum length so that a plurality of such cards equal in number to the plurality of dice are supportable individually on the dice in bridging relation between the upwardly disposed surfaces of the die and the other surfaces of the bar means.

* * * * *